US009359720B2

(12) United States Patent
Chuda et al.

(10) Patent No.: US 9,359,720 B2
(45) Date of Patent: Jun. 7, 2016

(54) SELF-ADHESIVE WATER-ACTIVABLE GLASS WEB

(71) Applicant: SAINT-GOBAIN ADFORS, Chambery (FR)

(72) Inventors: Katarzyna Chuda, Asnieres sur Seine (FR); Erisela Nikaj, Paris (FR); Bohuslav Mikulechy, Usti nad Orlici (CZ); Filip Suchy, Nove Mesto na Morave (CZ)

(73) Assignee: SAINT-GOBAIN ADFORS, Chambery (FR)

( * ) Notice: Subject to any disclaimer, the term of this patent is extended or adjusted under 35 U.S.C. 154(b) by 43 days.

(21) Appl. No.: 14/405,198

(22) PCT Filed: May 30, 2013

(86) PCT No.: PCT/FR2013/051215

§ 371 (c)(1),
(2) Date: Dec. 3, 2014

(87) PCT Pub. No.: WO2013/182783

PCT Pub. Date: Dec. 12, 2013

(65) Prior Publication Data

US 2015/0114545 A1 Apr. 30, 2015

(30) Foreign Application Priority Data

Jun. 4, 2012 (FR) ..... 12 55158

(51) Int. Cl.

| | |
|---|---|
| ***E04B 2/00*** | (2006.01) |
| ***E04F 13/07*** | (2006.01) |
| ***E04F 13/16*** | (2006.01) |
| ***E04F 13/18*** | (2006.01) |
| ***C09J 5/04*** | (2006.01) |
| ***B29C 65/48*** | (2006.01) |
| ***B32B 37/12*** | (2006.01) |
| ***B32B 43/00*** | (2006.01) |
| ***C08J 5/08*** | (2006.01) |
| ***D06N 7/00*** | (2006.01) |

(52) U.S. Cl.

CPC ..... *D06N 7/0002* (2013.01); *D06N 7/0092* (2013.01); *D06N 2201/082* (2013.01); *D06N 2209/126* (2013.01); *Y10T 428/2481* (2015.01); *Y10T 442/2098* (2015.04); *Y10T 442/2754* (2015.04)

(58) Field of Classification Search

USPC ..... 156/71, 305, 306.9, 307.1, 307.3, 156/307.4, 307.7; 428/40.1, 42.1, 196, 197, 428/210, 299.4, 343, 350; 442/71, 151

See application file for complete search history.

(56) References Cited

U.S. PATENT DOCUMENTS

| | | | | | |
|---|---|---|---|---|---|
| 3,616,146 | A * | 10/1971 | Gabet | C09J 7/04 | 156/88 |
| 3,849,240 | A * | 11/1974 | Mikulak | C09J 7/00 | 138/149 |
| 4,061,820 | A * | 12/1977 | Magid | C09J 7/0289 | 156/295 |
| 4,082,890 | A * | 4/1978 | Burton | B44C 1/105 | 428/328 |
| 4,277,527 | A * | 7/1981 | Duhl | B32B 5/08 | 428/109 |
| 4,317,555 | A * | 3/1982 | Hogg | A47G 1/168 | 248/467 |
| 4,331,576 | A * | 5/1982 | Colon | C09J 7/0021 | 156/331.6 |
| 4,783,354 | A * | 11/1988 | Fagan | C09J 7/0207 | 427/152 |
| 4,889,234 | A * | 12/1989 | Sorensen | B65D 5/708 | 206/459.5 |
| 5,202,181 | A * | 4/1993 | Hara | C09J 7/02 | 428/350 |
| 5,296,277 | A * | 3/1994 | Wilson | C09J 7/0207 | 428/119 |
| 5,487,929 | A * | 1/1996 | Rusincovitch, Jr. | B44C 5/0461 | 428/161 |
| 5,643,668 | A * | 7/1997 | Calhoun | B32B 7/04 | 428/317.3 |
| 6,337,104 | B1 | 1/2002 | Draxo et al. | | |
| 6,596,359 | B2 * | 7/2003 | Roth | B31D 1/021 | 156/250 |
| 6,858,285 | B1 * | 2/2005 | Hamilton | B32B 3/28 | 428/156 |
| 2002/0106494 | A1 * | 8/2002 | Roth | B31D 1/021 | 428/198 |
| 2004/0134606 | A1 * | 7/2004 | Tsutsui | B27D 1/04 | 156/307.7 |
| 2005/0000642 | A1 * | 1/2005 | Everaerts | C09J 7/0242 | 156/273.1 |
| 2005/0112314 | A1 * | 5/2005 | Hamilton | B32B 3/28 | 428/40.1 |
| 2010/0236159 | A1 * | 9/2010 | Hyer | E04F 13/002 | 52/105 |
| 2014/0234593 | A1 * | 8/2014 | Umeda | B65C 9/22 | 428/201 |

FOREIGN PATENT DOCUMENTS

| | | | |
|---|---|---|---|
| DE | 81 24 330 | 11/1981 | |
| DE | 297 18 222 | 2/1999 | |
| EP | 0 445 461 | 9/1991 | |
| EP | 1 035 187 | 9/2000 | |
| EP | 1 162 306 | 12/2001 | |
| EP | 1 707 667 | 10/2006 | |
| WO | WO 2012158538 A2 * | 11/2012 | C09J 7/0239 |

OTHER PUBLICATIONS

International Search Report Issued Sep. 18, 2013 in PCT/FR13/051215 Filed May 30, 2013.

* cited by examiner

*Primary Examiner* — Sing P Chan

(74) *Attorney, Agent, or Firm* — Oblon, McClelland, Maier & Neustadt, L.L.P.

(57) ABSTRACT

The invention relates to a self-adhesive wall covering comprising a glass textile with a closed structure, consisting of glass fibers and of a water-permeable polymer binder, and an adhesive coating comprising both a pressure-sensitive adhesive (PSA) and a water-activable latent adhesive. The definitive attachment to the wall of this repositionable self-adhesive covering takes place, after hanging, by applying one or more coats of water-based paint.

15 Claims, No Drawings

SELF-ADHESIVE WATER-ACTIVABLE GLASS WEB

The present invention relates to a repositionable self-adhesive wall covering, based on glass fibers, the definitive adhesion of which to the wall may be obtained, after hanging, by applying water or a water-based paint composition.

Wall coverings based on glass fibers have been known for very many years. They are easy to apply and relatively good value, can be painted with water-based paints, are washable after painting, and have better tear resistance, fire resistance and moisture resistance than wallpapers. Hanging a conventional wall covering based on glass fibers typically comprises the following successive steps:

pasting the wall and/or the wall covering (approx. 5 hours),
applying the wall covering to the wall (approx. 5 hours),
drying of the adhesive (approx. 24 hours),
applying a first coat of paint (approx. 4 hours),
drying of the first coat of paint (approx. 24 hours),
applying a second coat of paint (approx. 4 hours), and
drying of the second coat of paint (approx. 24 hours), the indications of time being those estimated for a 15 $m^2$ room with 35 $m^2$ of walls.

The objective of the present invention is to substantially shorten and facilitate the bonding phase (steps 1-3). It proposes a wall covering based on glass fibers that is pre-pasted with a particular adhesive system.

Various pre-pasted wall coverings based on glass fibers have already been described and placed on the market.

Thus, the Applicant sells, under the name EasyGlue®, a glass cloth pre-pasted with a conventional starch-based adhesive. The user must activate the adhesive by wetting it before hanging the wall covering. The pasting step is thus replaced by the wetting step, which is slightly faster. The step of applying to the wall is not however substantially facilitated.

Furthermore, more recently a self-adhesive glass cloth has been offered, under the trade name EasyFix®. It is a glass textile with an open structure that comprises, on one of its faces, a repositionable self-adhesive coating also referred to as a pressure-sensitive adhesive (PSA). This adhesive enables easy application of the glass textile to the wall without prior pasting or wetting. The definitive attachment then takes place when paint is applied. Specifically, this paint penetrates via the openings of the glass textile and, after drying, bonds it firmly to the wall. The user is thus spared the pasting step and the adhesive drying step.

However, this system has, as main drawbacks, the fact that such a textile with an open structure is, for esthetic reasons, unsuitable as a ceiling cover, and the fact that this mechanism of adhesion via the paint renders the wall covering very difficult to remove.

Furthermore, there are a certain number of documents that disclose, on the one hand, self-adhesive wallpapers (see for example WO 95/17312, WO 93/06301, U.S. Pat. No. 5,441,778, U.S. Pat. No. 5,412,829, EP 1 707 667 and WO 00/31201) and, on the other hand, water-activated pre-pasted wallpapers (see for example WO 2004/003286, U.S. Pat. No. 4,714,723 and EP 1 162 306). To the Applicant's knowledge, there is no description of wallpapers that are both self-adhesive and water-activable.

Thus, there is no completely satisfactory system that makes it possible to easily and rapidly hang a textile covering based on glass fibers on the wall and to bond it definitively without pasting the wall or the covering, while retaining a certain ease of removal after wetting of the wall covering.

The present invention is based on the idea of trying to combine, on one and the same wall covering, both the self-adhesive/repositionable function)(EasyFix® and the function of definitive bonding by wetting (activation) of a latent adhesive)(EasyGlue®.

This combination appears a priori impossible. Indeed, it is well known that PSAs generally only function on dry supports and that the presence of water at the interface is incompatible with a self-adhesiveness of PSA type.

The idea that has enabled this unfavorable technical prejudice to be overcome is to activate the latent adhesive only after correct positioning of the wall covering on the wall/ceiling. The PSA function is then weakened or even inactivated by water, but immediately replaced by the conventional adhesivity function of the water-activable latent adhesive. This activation of the latent adhesive could, certainly, be carried out by simple application of water after hanging, but it would be even more advantageous to provide this activation water in the form of an aqueous paint composition. Two steps (activation+painting) would thus be combined in a single step.

Two apparently incompatible desires are then again faced: wanting to use the water from a paint composition for the activation of an adhesive interface while preventing said paint composition from penetrating through the glass textile to said interface.

The solution to this problem lies in the choice of a glass textile having a closed structure which, unlike that used for the EasyFix® product, is impermeable to the paint and which, in the manner of a filter, only lets through the aqueous phase of this paint.

Consequently, one subject of the present invention is a self-adhesive wall covering comprising:

(A) a glass textile with a closed structure, consisting of glass fibers and of a water-permeable polymer binder, and
(B) an adhesive coating comprising both a pressure-sensitive adhesive (PSA) and a water-activable latent adhesive.

Another subject of the present invention is a method of hanging such a self-adhesive wall covering.

The expression "wall covering" is understood to mean a flat product in the form of a strip having a width generally between a few tens of centimeters and around 1 meter, stored and sold in the form of a roll. This covering is intended to be bonded to the walls of a room or of a building or else to other surfaces such as the ceiling, with the exclusion of floors.

In the present invention, the expression "glass textile having a closed structure" is understood to mean a woven or nonwoven textile having a permeability to the flow of air, measured according to the standard ISO 9237 at 200 Pa, at most equal to 50 $l/(m^2 \cdot s)$.

Such a glass textile does not comprise openings that are visible to the naked eye and consequently has a closed, uniform and more or less structured appearance.

Such a textile may be a glass cloth (woven structure) or a glass veil (nonwoven structure). It is preferably a glass cloth. Its cohesion is provided in a known manner by a polymer binder. This polymer binder must be both insoluble in water, but sufficiently hydrophilic to allow through the water needed for the activation of the latent adhesive applied to one face of the glass textile.

Such water-permeable polymer binders are known in the art and are generally based on hydrolyzed starches, hydrophilic acrylic resins, in particular anionic styrene/acrylic resins, and/or styrene-butadiene rubber (SBR).

Glass textiles that can be used for the present invention are available on the market and are sold by the Applicant, for example under the name Novelio®.

Their surface density (grammage) is advantageously between 80 and 450 $g/m^2$, preferably between 100 and 300 $g/m^2$ and in particular between 150 and 250 $g/m^2$.

The adhesive coating is applied to only one face of the glass textile. It may have a structure of monolayer type, that is to say the adhesive composition that has been used for its formation may contain both the pressure-sensitive adhesive (PSA) and the water-activable latent adhesive. In this embodiment, the water-activable latent adhesive is then present in the adhesive coating (B) in an amount of from 5 to 150 g/m$^2$, preferably from 50 to 120 g/m$^2$, in particular from 80 to 100 g/m$^2$, and the PSA in an amount of from 5 to 80 g/m$^2$, preferably from 10 to 50 g/m$^2$, in particular from 25 to 40 g/m$^2$.

In one preferred embodiment, the adhesive coating has a bilayer or multilayer structure, in which the PSA and the water-activable latent adhesive are present in the form of two distinct adhesive layers, applied separately from two different adhesive compositions.

Each of these layers may, independently of the other, be continuous or discontinuous, the term "discontinuous" encompassing both the layers consisting of a plurality of separate elements and the layers comprising a plurality of openings distributed more or less evenly over the entire surface of the layer.

In this embodiment where the adhesive coating has a two-layer structure, the layer containing the water-activable latent adhesive is preferably that deposited directly on the glass textile, and the layer containing the PSA component is deposited, subsequently, on the latent adhesive layer.

In one preferred embodiment of the invention, the adhesive coating (B) consequently comprises (B1) a first, continuous or discontinuous, adhesive layer formed by the water-activable latent adhesive, said first layer being deposited directly onto the glass textile, and (B2) a second, continuous or discontinuous, layer formed by a PSA, said second layer being deposited onto the first layer (B1) and/or next to the latter.

When the first layer (B1) is a discontinuous layer, the second layer (B2) may of course extend beyond the first layer and be in contact directly with the glass textile in the zones between the discrete elements or in the zones corresponding to the openings of the first layer. Mention may be made, by way of example, of a pattern where the first layer is formed by a first set of straight lines, parallel to one another, and the second layer is formed by another set of straight lines, parallel to one another, but perpendicular to the first lines.

The deposition of two discontinuous layers deposited next to one another, for example in the style of the squares of a chessboard, could also be envisaged.

In one particularly advantageous embodiment of the present invention, the first adhesive layer (B1), that is to say the one formed by the water-activable latent adhesive, is a continuous layer deposited on the whole of one face of the glass textile (A). This continuity of the water-activable adhesive actively provides a definitive, satisfactory and even adhesion, without the formation of blisters or zones of lower adhesion.

On this first continuous layer, a second discontinuous adhesive layer (B2) consisting of separate elements is then advantageously laid. The ratio of the area of the surface B2 to the area of the surface B1 is preferably less than 0.5, in particular less than 0.3 and ideally less than 0.1. This embodiment may be advantageous, for example, when the presence of PSA risks weakening the adhesion of the water-activable adhesive of the first layer.

For easy hanging of the covering, the latter must have a sufficient initial tack to adhere by simple contact/pressure to a clean and dry wall and to not peel off under the effect of its own weight. In a known manner, this tack must not however exceed a certain value so that the wall covering remains easily peelable and repositionable as long as it has not been wetted.

The adhesive coating (B), whether it is in monolayer or multilayer form, advantageously has an initial adhesive strength of between 0.2 and 2 N. This adhesive strength is measured in the manner described in the examples below.

The tack is exclusively due to the pressure-sensitive adhesive and the adjustment of this adhesive strength is part of the general knowledge of the person skilled in the art who will know how to choose the nature and the concentrations of the various ingredients of the pressure-sensitive adhesive (such as polymers, tackifying agent, fillers, etc.) or else the geometry or thickness of the PSA layer.

The pressure-sensitive adhesives that can be used in the present invention are known.

They may be deposited in the form of a liquid composition based on an organic solvent or water (latex) or else they may be thermofusible polymers, that is to say polymers of low molecular weight which, in the melt state, have a low enough viscosity to spread out in a suitable manner.

The PSAs are generally based on an elastomer resin that may contain an agent that increases the tack (tackifying agent).

The polymer resin is conventionally selected from acrylic resins, butyl rubber, ethylene/vinyl acetate (EVA) copolymers, natural rubber, vinyl ethers, and styrene-based block copolymers such as styrene-butadiene-styrene (SBS), styrene-ethylene/butylene-styrene (SEBS), styrene-ethylene/propylene (SEP) and styrene-isoprene-styrene (SIS) copolymers.

EVA and styrene-based block copolymers have the advantage of being thermofusible elastomers and can therefore be applied in the form of a solvent-free composition.

The second adhesive layer, that is to say the one formed by the PSA, advantageously has a dry surface density of between 1 and 80 g/m$^2$, preferably of between 2 and 50 g/m$^2$, and in particular of between 4 and 40 g/m$^2$.

This second pressure-sensitive adhesive layer is deposited on and/or next to a first layer formed by the water-activable latent adhesive. This latent adhesive, when it is in the dry state, is completely inactive, that is to say devoid of bonding nature.

In principle, it is possible to use any adhesive conventionally used for bonding wallpapers and other wall coverings, such as for example adhesives based on starches, in particular potato, maize or wheat starches, starches modified by hydrolysis or cooking, dextrins, cyclodextrins, monosaccharides and oligosaccharides, cellulose alkyl ethers and cellulose hydroxyl ethers, polyethylene glycol, hydrophilic polyurethanes, polyacrylamides, aqueous vinyl adhesives such as homopolymers of preferably plasticized polyvinyl acetate (PVAC), partially hydrolyzed polyvinyl acetate, polyvinyl alcohol, polyvinylpyrrolidone, vinylpyrrolidone/vinyl acetate copolymers, maleic anhydride/methyl vinyl ether copolymers or copolymers of vinyl acetate and maleates or acrylates. Of course, the water-activable latent adhesive may be a mixture of these natural and synthetic polymers, as long as the mixture is not tacky in the dry state and becomes a viscous and sticky fluid only after coming into contact with water.

Such a water-activable latent adhesive may contain, in a known manner, salts intended to increase its affinity for water.

The addition of such salts reduces however the water resistance of the adhesive layer and must therefore be limited as much as possible.

Mention may be made, as examples of commercial products that can be used as water-activable latent adhesive, of the product Craymul® 4366, based on polyvinyl acetate homopolymer and dextrin, sold by Arkema, or the product Luvitee® VA64W from BASF.

This adhesive is used in standard amounts, generally of between 5 and 150 g/m$^2$, preferably of between 50 and 120 g/m$^2$, in particular of between 80 and 100 g/m$^2$, these indications corresponding to the dry surface density.

The wall covering of the present invention enables the implementation of an extremely simple and rapid method that is made possible owing to the dual functionality of the adhesive layer containing both a pressure-sensitive adhesive and a water-activable latent adhesive.

The method for hanging the wall covering comprises the following successive steps:

applying a strip of said wall covering to a support, so that the adhesive coating is in contact with said support, if necessary, repositioning said strip of wall covering, applying water or an aqueous composition to the wall covering.

The support, preferably a wall or a ceiling, must be clean and dry in order to guarantee good initial adhesivity of the covering.

When the strip of covering is correctly placed, it is possible to apply pressure, for example using a smoothing blade or a roller in order to make it adhere to the support before the water activation step.

The activation of the latent adhesive is carried out by applying water over the whole of the surface of the wall covering. This application of water may be carried out by any suitable means, for example by spraying or using a roller.

In one particularly advantageous embodiment, at least one coat of water-based paint is applied, preferably using a paint roller, to the wall covering brought into contact with the support and optionally smoothed.

It may be necessary to dilute the paint composition beforehand with water, typically between 10% and 30% water.

EXAMPLES

Adhesive Coating Comprising Two Separate Layers of Adhesive

Applied to a Novelio® closed glass cloth having a surface density of 180 g/m$^2$ and a permeability to the flow of air of 10 l/(m$^2$·s) is a continuous layer of a water-activable latent adhesive based on a homopolymer of vinyl acetate and dextrin sold by Arkema under the name Craymul® 4366. This layer is applied in an amount of 80-90 g/m$^2$. Applied to this layer, after complete drying of this first layer in an oven at 70° C., is a second continuous layer of a pressure-sensitive adhesive based on acrylic resin (Craymul® 4508) sold by Arkema. The grammage of this layer after drying is around 30 g/m$^2$.

The double adhesive layer obtained in this manner has an initial adhesivity of around 0.47 N, sufficient to attach the wall covering to the wall by simple manual pressure. It can be repositioned several times. After applying a coat of water-based acrylic paint (SilverPro AS-60) and drying, a satisfactory definitive attachment is obtained.

All the coverings received two coats of acrylic paint.

The table below shows the various adhesivity values (initial adhesivity, adhesivity after one and two repositionings, definitive adhesivity after water activation) of the wall covering according to the invention in comparison with a standard glass cloth bonded to the wall by a standard vinyl adhesive (Ovalit® U), an EasyGlue® glass cloth, an EasyFix® glass cloth.

These various adhesivities (resistance to peeling) were measured in the following manner:

A sample of the glass cloth was bonded to a plasterboard (5 cm×10 cm) attached to a support. For the self-adhesivity tests (initial adhesive strength, after first repositioning and after second repositioning), a controlled pressure of 2500 kg is exerted. For the test after painting, the pressure is manual (paint roller). A strip having a width of 2 cm (length 10 cm) is cut, with a cutter, from the cloth sample and this strip is subjected to a 90° C. peel test on a tensile testing machine sold by Zwick. The peel rate is 20 mm/minute. The results from the table below correspond to the mean value±standard deviation, calculated over three tests.

| | Glass cloth according to the invention | Standard glass cloth | EasyGlue ® | EasyFix ® |
|---|---|---|---|---|
| Initial A.S. | 0.47 ± 0.05 | — | 0 | 0.22 ± 0.05 |
| First repositioning A.S. | 0.20 ± 0.05 | — | 0 | 0.21 ± 0.05 |
| Second repositioning A.S. | 0.21 ± 0.08 | — | 0 | 0.22 ± 0.03 |
| A.S. after water activation | 5.2 ± 1.5 | 4.3 ± 0.1 | 4.7 ± 0.5 | 4.9 ± 0.1 |
| Total hanging time estimated for 35 m$^2$ | 69 hours | 103 hours | 100 hours | 69 hours |

A.S. = adhesive strength in newtons (N)

The total hanging time of the wall covering was estimated on the basis of the various steps mentioned in the introduction.

It can be seen that the glass cloth according to the invention has satisfactory self-adhesivity properties, comparable to those of the EasyFix® glass cloth having an open structure. The application of two coats of acrylic paint makes it possible to bond the glass cloth according to the invention definitively to the wall with an adhesive strength slightly greater than that of the comparative products (standard, EasyGlue® and EasyFix® glass cloth).

Examination of the adhesive joint of the glass cloth according to the invention shows that the particles of latex and the pigments of the acrylic paint have not penetrated the glass cloth. The latter can be removed from the wall with the same ease as the standard glass cloth and the EasyGlue® product.

The glass cloth according to the invention thus combines the advantages of the products from the prior art, namely rapid and easy hanging, absence of pasting of the walls and of the covering, and a relatively easy removal.

The invention claimed is:

1. A self-adhesive wall covering comprising:

(A) a glass textile with a closed structure, consisting of glass fibers and of a water-permeable polymer binder; and (B) an adhesive coating comprising both a pressure-sensitive adhesive (PSA) and a water-activable latent adhesive.

2. The wall covering as claimed in claim 1, wherein the PSA and the water-activable latent adhesive are present in the adhesive coating as two separate, continuous or discontinuous, adhesive layers.

3. The wall covering as claimed in claim 2, wherein the adhesive coating (B) comprises:

(B1) a first, continuous or discontinuous, adhesive layer comprising the water-activable latent adhesive, deposited directly onto the glass textile; and (B2) a second, continuous or discontinuous, layer comprising a PSA, deposited onto the first layer (B1) and/or next to the first layer (B1).

4. The wall covering as claimed in claim 3, wherein the first adhesive layer (B1) is a continuous layer deposited on an entire face of the glass textile (A).

5. The wall covering as claimed in claim 4, wherein the second adhesive layer (B2) is a discontinuous layer consisting of separate elements, deposited on the first adhesive layer (B1); and wherein a ratio of surface areas B2/B1 is less than 0.5.

6. The wall covering as claimed in claim 3, wherein the first adhesive layer has a dry surface density of between 5 and 150 $g/m^2$.

7. The wall covering as claimed in claim 3, wherein the second adhesive layer has a dry surface density of between 1 and 80 $g/m^2$.

8. The wall covering as claimed in claim 1, wherein the glass textile is a glass veil or a glass cloth.

9. The wall covering as claimed in claim 1, wherein the water-activable adhesive comprises at least one one organic polymer selected from the group consisting of starches, starches modified by hydrolysis or cooking, dextrins, cyclodextrins, monosaccharides, oligosaccharides, cellulose alkyl etherscellulose hydroxyalkyl ethers, polyethylene glycol, polyvinylpyrrolidone, vinylpyrrolidone/vinyl acetate copolymers, hydrophilic polyurethanes, polyacrylamides, maleic anhydride/methyl vinyl ether copolymers, polyvinyl acetate (PVAC), partially hydrolyzed polyvinyl acetate, polyvinyl alcohol, and copolymers of vinyl acetate with maleates or acrylates.

10. The wall covering as claimed in claim 1, wherein the pressure-sensitive adhesive is at least one selected from the group consisting of acrylic adhesives and elastomer resins.

11. The wall covering as claimed in claim 1, wherein the glass textile (A) has a grammage of between 80 and 450 $g/m^2$.

12. The wall covering as claimed in claim 1, wherein the adhesive coating (B) has a monolayer structure.

13. The wall covering as claimed in claim 12, wherein the water-activable latent adhesive is present in the adhesive coating (B) in an amount of from 5 to 150 $g/m^2$ and the PSA is present in the adhesive coating (B) in an amount of from 5 to 80 $g/m^2$.

14. A method for hanging a wall covering, the method comprising, successively:

applying a strip of the wall covering as claimed in claim 1 to a support; so that the adhesive coating is in contact with said support;

if necessary, repositioning said strip of wall covering; and applying water or an aqueous composition to the wall covering.

15. The method as claimed in claim 14, wherein the aqueous composition is an aqueous-based paint.

* * * * *